United States Patent [19]

Jungbluth

[11] 4,201,023

[45] May 6, 1980

[54] THREE-DIMENSIONAL STRUCTURES MADE OF BEAMS AND PLATES

[76] Inventor: Otto Jungbluth, Frankensteiner Strasse 99, 6100 Darmstadt-Eberstadt, Fed. Rep. of Germany

[21] Appl. No.: 874,878

[22] Filed: Feb. 3, 1978

[30] Foreign Application Priority Data

Feb. 7, 1977 [DE] Fed. Rep. of Germany ..... 2704953

[51] Int. Cl.[2] ..... E04H 12/00

[52] U.S. Cl. ..... 52/334; 52/602; 52/650; 403/172

[58] Field of Search ..... 52/648, 334, 263, 637, 52/638, 319, 650, 602; 403/171, 172, 176

[56] References Cited

U.S. PATENT DOCUMENTS

| | | | |
|---|---|---|---|
| 742,755 | 10/1903 | Uffelman | 52/638 |
| 3,103,025 | 9/1963 | Gassner | 52/334 |
| 3,470,663 | 10/1969 | Tate | 52/263 |
| 3,564,802 | 2/1971 | Dreyfus | 52/637 |
| 3,800,490 | 4/1974 | Conte | 52/334 |
| 3,807,120 | 4/1974 | Viandon | 52/638 |
| 3,829,999 | 8/1974 | Bernstein | 52/648 |
| 4,050,257 | 9/1977 | Parks | 52/263 |

FOREIGN PATENT DOCUMENTS

| | | | |
|---|---|---|---|
| 2519664 | 11/1976 | Fed. Rep. of Germany | 52/650 |
| 558790 | 9/1923 | France | 52/263 |

OTHER PUBLICATIONS

Space Grid Structures by T. Borrego, ©1968 by M. I. T.

*Primary Examiner*—James A. Leppink
*Assistant Examiner*—Henry E. Raduazo
*Attorney, Agent, or Firm*—Frishauf, Holtz, Goodman and Woodward

[57] ABSTRACT

Three-dimensional structures made of open or closed profiled metal beams and plates are disclosed. Said structures comprise a plurality of parallel frame beams connecting the side flange junctions with respective joists and connecting the top flanges of the frame beams with plates. The structure is divided into frame beams modules easily fabricated in factories and easily transported and then joists are fit at the construction site, thereby resulting in a high degree of prefabrication and shortened installation time.

17 Claims, 7 Drawing Figures

THREE-DIMENSIONAL STRUCTURES MADE OF BEAMS AND PLATES

BACKGROUND OF THE INVENTION

This invention relates to three-dimentional structures made of open or closed profiled metal beams and plates. Two and three dimensionally distributed loan transference leads, in practice with the help of plates and space beams, to economical construction of various forms.

SUMMARY OF THE INVENTION

One object of this invention is to integrate the principles of construction using only orthogonally arranged structural members with the optimum connecting technology and suitable choice of fabrication in factory and installation site, so as to attain an architecturally harmonic configuration with improved loading capacity at lower cost.

Other objects and advantages of this invention may become apparent to those skilled in the art from the following description and drawings.

DESCRIPTION OF THE PREFERRED EMBODIMENT

The object of this invention is achieved by constructing a three-dimensional structure using frame beams (girders) to which extending at right angles are welded equally spaced joists, the joists being provided with a bottom flange so as to increase resistance to bending, torsion and transversal force. The frame beam and joist members may be open or closed.

One further characteristic of this invention is shearproof doweling of the plates to the top flanges of the frame beams, as a result of which said frame beams may be weaker than either the continuous flat or even short pieces of flat rolled steel members placed in the region of vertical web members to take up the bonding means.

In order to reduce construction cost, the distances between the sides of the frame beams should be changed depending on the type and the amount of load, method of the construction of the plates and whether the purpose of application is as flooring or roof structure but should not be more than three times the space between adjacent vertical web members in view of the optimal three dimensional action of the load.

The mutual static, constructural and architectural effect of the three dimensional load structure consisting of orthogonally placed load bearing members like beams or plates makes this structure superior to the conventional space structure in which the plates for roof and floors do not compensate a part of the load bearing members.

Figure 3A:
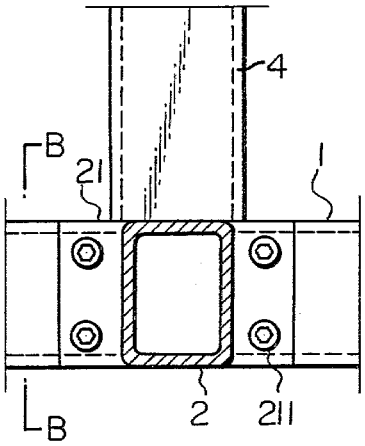
FIGS. 3A and 3B show sectional views looking along the line A-A of FIG. 3B and the line B-B of FIG. 3A, respectively of a joint connection of bottom flange of rectangular hollow profile.
Figure 3B:
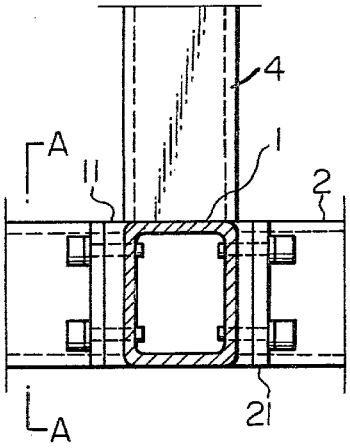
Figure 4A:
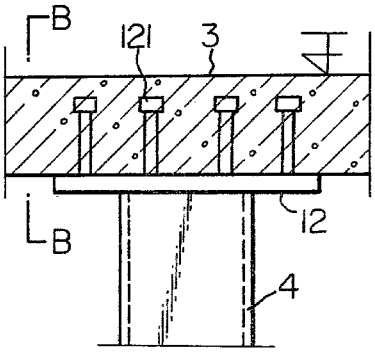
FIGS. 4A and 4B show sectional views looking along the line A-A of FIG. 4B and the line B-B of FIG. 4A, respectively of a shearproof doweling of a steel-concrete plate using bolt-headed dowels, which are welded on the connecting plate of the top flange.
Figure 4B:
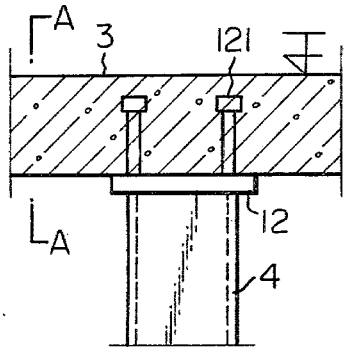

The joists connecting two neighboring bottom flange beams are secured to each end plate by at least 2, but preferably 4 bolts as shown in drawings. For this purpose, the outer vertical areas of the points of junctions of the side or bottom flanges are welded with end plates punched correspondingly. By sufficiently utilizing the larger plastic load reserve at the highly stressed joint points in the sense of the plastic hinge measurement, its rigidity is enhanced at the same time by the end plates. For this reason, the thickness of the end plates is at least equal to that of the side or bottom flange or the beam and the length is at least twice as much as the width of the vertical web member, respectively. In the case of application of closed profile configuration, preferably of rectangular hollow section see FIGS. 3A and 3B, the bolt holes of the end plates are provided with threads.

Figure 1:
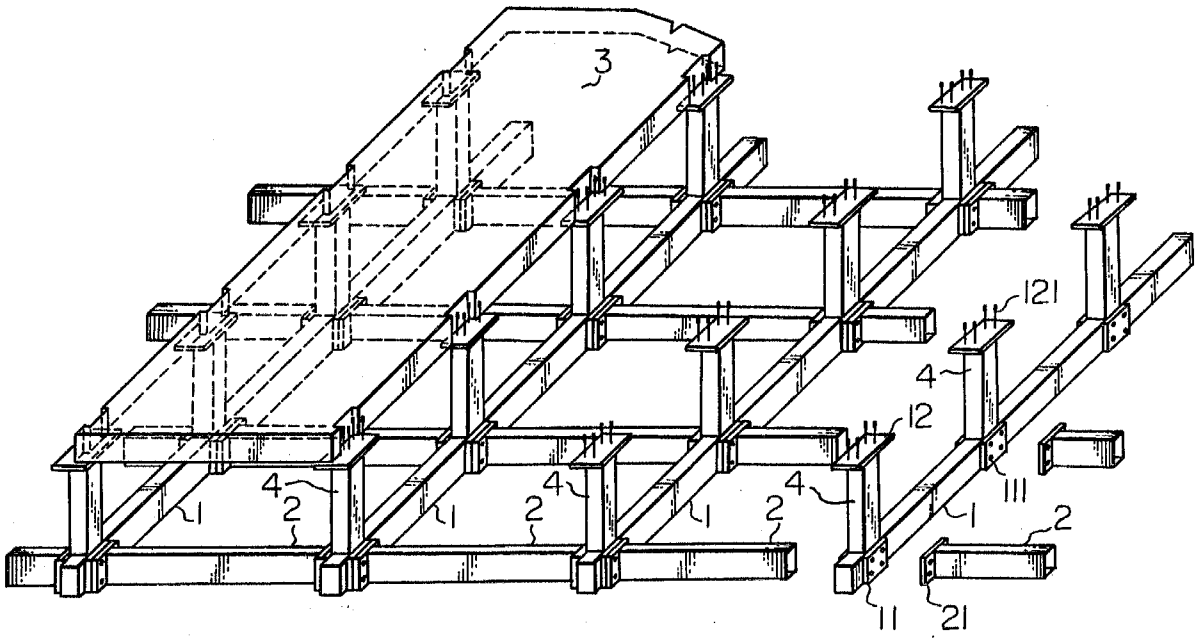
FIG. 1 shows a perspective view of the three-dimensional structure made of closed (hollow) profiled steel.
Figure 2A:
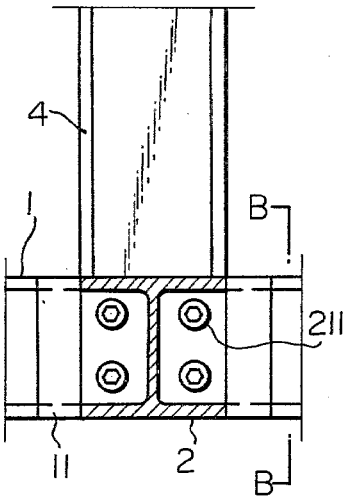
FIGS. 2A and 2B show sectional views looking along the line A-A of FIG. 2B and the line B-B of FIG. 2A, respectively, of a joint connection of bottom flange of I-beams.
Figure 2B:
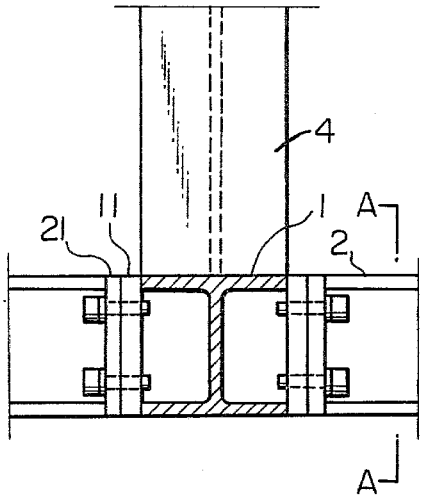

Plates 3 (FIG. 1) of reinforced concrete, profiled steel sheets or profiled steel and other composite sheets which are normally continuously supported longitudinally and transversely at several fields of planning grids are connected with bolt-headed dowels, set bolts or other connecting means with the top flanges or part thereof by known methods.

One of such plate-grating structures fabricated according to this invention and in which the load is transferred three dimensionally over the whole space structure is suitable for the longest spans and therefore needs only a few supports. The supply lines can bring up the frames from all horizontal directions. The installation of a subfloor can be done easily because of the relatively close planning grids. A storeywise assembling of the whole structure after the installation of the supply lines is suitable for the floors especially with the lift-slab process.

It is especially economically advantageous to divide the three dimensional frame structure into frame beam modules easily fabricated in factories and easily transported and then fit joists at the construction site. This reason along with the fact that only a few kinds of structural members are required, leads to a high degree of prefabrication and shortened installation time.

In FIGS. 1 to 4, the numeral 1 represents the frame beams and the numeral 2 represents the joists with the end plates 21 which are secured to connecting plates 11 (attached to side flanges of beams 1) by means of bolts 211. The flat steel-concrete roof plates 3 are connected with Vertical web members 4 are connected to the frame beams 1. Vertical webs 4 by means of headed bolts 121. As seen in FIGS. 4A and 4B, the top flange connecting plates 12 are welded to the end faces of the vertical web members 4 of the frame beams and take up the headed bolts 121 for the doweling of steel-concrete plates 3. The frame beams 1 and vertical webs 4 may have an open profile (FIG. 2B) or a closed (hollow) profile (FIG. 3B). The joists may have an open profile (FIG. 2A) or a closed (hollow) profile (FIG. 3A).

What is claimed is:

1. A three dimensional structure comprising:

a plurality of substantially parallel profiled metal frame beams (1) arranged in a substantially horizontal direction;

a plurality of spaced apart substantially vertical profiled metal web members (4) coupled to said horizontal frame beams (1);

adjacent ones of said horizontal frame beams (1) being spaced apart a greater distance than the spacing between adjacent vertical web members (4) but no more than three times the spacing between adjacent vertical web members (4);

a plurality of substantially parallel profiled metal joists (2) connected between adjacent ones of said horizontal frame beams (1) and extending substantially perpendicularly to said frame beams in a substantially horizontal direction;

said frame beams (1) each having substantially vertical side flanges;

connecting and reinforcing means (11, 21, 211) coupled to said side flanges of said frame beams (1) and to ends of said joists (2) for connecting said side flanges of a frame beam (1) with respective joists (2) to provide greater resistance to bending, transversal force and torsion and for reinforcing the respective junction areas of a frame beam (1) and respective joists (2);

a top sheet-like member (3); and plate means (12,121) connecting top portions of said vertical web members (4) to said sheet-like top member (3).

2. the three-dimensional structure of claim 1 wherein said connecting and reinforcing means comprises face plate joints for connecting said joist (2) with said side flanges of said beams (1), said face plate joints each including a first connecting plate (11) connected to the outer vertical surface of the side flange of said beam (1), said connecting plate having a thickness at least equal to that of said side flange and a length of at least twice the width of the vertical web member (4) at said joint, and bolt means connecting said joists (2) to the respective face plates (11).

3. The three-dimensional structure of claim 1 wherein said face plate joints each further include a second connecting plate (21) connected to the ends of said joists, said bolt means connecting said first and second connecting plates together.

4. The three dimensional structure of claim 3 wherein said first connecting plates are welded to said side flanges of said beams, and said second connecting plates are welded to the ends of said joists.

5. The three-dimensional structure of claim 2 wherein said first connecting plates have threaded holes therein for threadably receiving said bolt means.

6. The three-dimensional structure of claim 2 wherein said bolt means comprises at least two bolts.

7. The three-dimensional structure of claim 2 wherein said bolt means comprises at least four bolts.

8. The three-dimensional structure of claim 2 wherein the cross-sectional area of the top flanges of said frame beams (1) is less than that of said side flanges thereof.

9. The three-dimensional structure of claim 8 wherein said top flanges of said frame beams (1) are made of flat rolled steel.

10. The three-dimension structure of claim 9 wherein said top flanges of said frame beams (1) are made of rolled steel pieces having a width is no greater than twice the width of the vertical web members (4).

11. The three-dimensional structure of claim 1 wherein said top sheet-like member (3) is supported over a plurality of said vertical web members (4) in a substantially horizontal plane.

12. The three-dimensional structure of claim 11 wherein said top sheet-like member (3) is connected to said plate means (12,121) of said vertical web members (4) by means of a plurality of shear-proof elongated members.

13. The three-dimensional structure of claim 1 wherein said top sheet-like member (3) is connected to said plate means (12,121) of said vertical web members (4) by means of a plurality of shear-proof elongated members.

14. The three-dimensional structure of claim 12 wherein said top sheet-like member comprises reinforced concrete.

15. The three-dimensional structure of claim 1 wherein said top sheet-like member comprises reinforced concrete.

16. The three-dimensional structure of claim 1 wherein at least one of said frame beams, vertical web members and horizontal joists comprise closed profile (hollow) members.

17. The three dimensional structure of claim 1 wherein at least one of said frame beams, vertical web members and horizontal joists comprise open profile members.

* * * * *

UNITED STATES PATENT AND TRADEMARK OFFICE

CERTIFICATE OF CORRECTION

PATENT NO. : 4,201,023

DATED : May 6, 1980

INVENTOR(S) : Otto JUNGBLUTH

It is certified that error appears in the above-identified patent and that said Letters Patent are hereby corrected as shown below:

Column 2, line 17, after "application" change "of closed profile" to --of a closed profile--;

Column 2, lines 47 and 48, after "by means of bolts 211." insert --Vertical web members 4 are connected to the frame beams 1.--; change "The flat steel-concrete roof plates 3 are connected with Vertical web members 4 are connected to the frame beams 1. Vertical webs 4 by means of headed bolts 121." to --The flat steel-concrete roof plates 3 are connected with the vertical webs 4 by means of headed bolts 121. The connecting plates 11 have threaded holes 111.--;

Column 4, line 16, change "a width is" to --a width which is--.

Signed and Sealed this

Fourth Day of November 198

[SEAL]

Attest:

SIDNEY A. DIAMOND

Attesting Officer

Commissioner of Patents and Trademar